US010640887B2

(12) United States Patent
Yao et al.

(10) Patent No.: US 10,640,887 B2
(45) Date of Patent: May 5, 2020

(54) CONTINUOUS PROCESSING DEVICE FOR FORMING BAMBOO FIBER AND METHOD THEREOF

(71) Applicant: JIYANG COLLEGE OF ZHEJIANG A&F UNIVERSITY, Zhuji, Zhejiang (CN)

(72) Inventors: Wenbing Yao, Zhuji (CN); Chao Zhou, Zhuji (CN)

(73) Assignee: JIYANG COLLEGE OF ZHEJIANG A&F UNIVERSITY, Zhuji, Zhejiang (CN)

( * ) Notice: Subject to any disclaimer, the term of this patent is extended or adjusted under 35 U.S.C. 154(b) by 145 days.

(21) Appl. No.: 15/770,496

(22) PCT Filed: Nov. 28, 2016

(86) PCT No.: PCT/CN2016/107446

§ 371 (c)(1),
(2) Date: Apr. 23, 2018

(87) PCT Pub. No.: WO2018/094722

PCT Pub. Date: May 31, 2018

(65) Prior Publication Data

US 2019/0055670 A1 Feb. 21, 2019

(51) Int. Cl.

| | |
|---|---|
| ***D01B 1/36*** | (2006.01) |
| ***D01B 1/16*** | (2006.01) |
| ***D01B 1/32*** | (2006.01) |
| ***D01B 1/10*** | (2006.01) |

(52) U.S. Cl.
CPC ..... *D01B 1/36* (2013.01); *D01B 1/10* (2013.01); *D01B 1/16* (2013.01); *D01B 1/32* (2013.01); *D10B 2201/10* (2013.01)

(58) Field of Classification Search
CPC ..... D01B 1/10; D01B 1/36
See application file for complete search history.

(56) References Cited

U.S. PATENT DOCUMENTS 2,747,232 A * 5/1956 Armstrong ..... D01B 1/10 19/9
2,860,902 A * 11/1958 Diels ..... B65B 13/26 289/2
2,913,270 A * 11/1959 Sachsenroder, Sr. ... B65B 51/08 289/2
3,464,877 A * 9/1969 Creighton ..... B27N 1/00 156/259
3,563,583 A * 2/1971 Gentry ..... A01G 17/085 289/2

(Continued)

*Primary Examiner* — Shaun R Hurley
(74) *Attorney, Agent, or Firm* — Leong C. Lei

(57) ABSTRACT

A continuous processing device for forming bamboo fiber includes a machine rail, a cart guide rail, a cart, and a clamp for clamping a bamboo strip. The cart and the clamp are connected through a connecting plate. The machine rail is formed with a slot along a path of the machine rail. The machine rail includes a head linear rail section, a conical spiral rail section and a tail linear rail section arranged in sequence. The cart guide rail includes a head linear guide rail section, a conical spiral guide rail section and a tail linear guide rail section arranged in sequence. A continuous processing method for forming bamboo fiber using the continuous processing device is disclosed.

4 Claims, 4 Drawing Sheets

(56) References Cited

U.S. PATENT DOCUMENTS

| | | | | |
|---|---|---|---|---|
| 8,414,035 | B2 * | 4/2013 | Bell | B65H 69/04<br>289/13 |
| 10,106,365 | B2 * | 10/2018 | Nikkanen | A01K 91/04 |

* cited by examiner

CONTINUOUS PROCESSING DEVICE FOR FORMING BAMBOO FIBER AND METHOD THEREOF

BACKGROUND OF THE INVENTION

1. Field of the Invention

The present invention relates to a bamboo process, and more particularly to a continuous processing device for forming bamboo fiber and a method thereof.

2. Description of the Prior Art

Bamboo retting is a prerequisite for the refined extraction of bamboo fiber and the basis for manufacturing conforming bamboo fiber. Demand for plant fiber has greatly increased with the boom in the emerging plant fiber industry.

Currently, fiber is mainly produced by mechanical method in the industry, i.e. bamboo is crushed to create cracks and bamboo fiber is separated out from thin bamboo sheets. However, the disadvantage of mechanical method is that the crushing force is not comparable with all specifications of bamboo, causing uneven pressure on different parts of the bamboo and creating uneven distribution of cracks, consequently affecting the extraction of bamboo fiber. There are also manufacturers that adopt the chemical method of producing bamboo fiber, i.e. bamboo is soaked in alkaline solution to obtain plant fiber through the degradation of hemicellulose and lignin. However, there are also defects such as low efficiency.

The main problem in the process of manufacturing bamboo fiber is that the fiber cannot be separated from the bamboo material well, which results in lower output rate. The fiber thickness is uneven, the processing procedure is complicated, the labor intensity is large, and the processing method is behind the times. However, the disadvantage of chemical method is that the disintegration of cellulose, hemicellulose and lignin is inconsistent on the inside and outside as the chemical solution acts on the surface of the bamboo, causing uneven fiber length and thickness in the interior. Consequently, conformance rate and output rate are low, fiber production cost is high, and fiber produced can only be used in fiberboard or low-grade composite materials.

SUMMARY OF THE INVENTION

One of the technical problems to be solved by the present invention is to provide a continuous processing device for forming bamboo fiber.

Another of the technical problems to be solved by the present invention is to provide a continuous processing method for forming bamboo fiber.

The present invention solves one of the above technical problems through the following technical solution. A continuous processing device for forming bamboo fiber is provided. The continuous processing device comprises a bracket, a machine rail for receiving a bamboo strip and having two ends open and hollow, a cart guide rail, a cart, and a clamp for clamping the bamboo strip. The machine rail and the cart guide rail are mounted on the bracket, respectively. The cart is slidably disposed on the cart guide rail. The clamp is located in the machine rail. The cart and the clamp are connected through a connecting plate. The machine rail is formed with a slot along a path of the machine rail. The connecting plate is inserted through the slot. The machine rail includes a head linear rail section, a conical spiral rail section and a tail linear rail section arranged in sequence. The conical spiral rail section has a helix angle of 10-30 degrees. The cart guide rail includes ahead linear guide rail section, a conical spiral guide rail section and a tail linear guide rail section arranged in sequence. The head linear rail section is arranged in parallel with the head linear guide rail section. The conical spiral rail section and the conical spiral guide rail section are arranged around a same central axis. The tail linear rail section is arranged in parallel with the tail linear guide rail section.

Preferably, the continuous processing device further comprises a pick-and-place section for picking and placing the bamboo strip. Two ends of the pick-and-place section are connected to the head linear rail section and the tail linear rail section, respectively.

Preferably, the cart is famed with a groove. Two sides of the groove are symmetrically provided with at least one pair of pulleys. The cart guide rail has a T-shaped cross-section. Two ends of a transverse portion of the cart guide rail cooperate with the pulleys at the two sides of the groove.

Preferably, the conical spiral rail section has a radius of 80-800 mm and 5-15 rail loops.

The present invention solves another of the above technical problems through the following technical solution. A continuous processing method for forming bamboo fiber is provided. The method continuous processing method uses the aforesaid continuous processing device. The continuous processing device comprises a bracket, a machine rail for receiving a bamboo strip and having two ends open and hollow, a cart guide rail, a cart, and a clamp for clamping the bamboo strip. The machine rail and the cart guide rail are mounted on the bracket, respectively. The cart is slidably disposed on the cart guide rail. The clamp is located in the machine rail. The cart and the clamp are connected through a connecting plate. The machine rail is formed with a slot along a path of the machine rail. The connecting plate is inserted through the slot. The machine rail includes ahead linear rail section, a conical spiral rail section and a tail linear rail section arranged in sequence. The conical spiral rail section has a helix angle of 10-30 degrees. The cart guide rail includes ahead linear guide rail section, a conical spiral guide rail section and a tail linear guide rail section arranged in sequence. The head linear rail section is arranged in parallel with the head linear guide rail section. The conical spiral rail section and the conical spiral guide rail section are arranged around a same central axis. The tail linear rail section is arranged in parallel with the tail linear guide rail section.

The continuous processing method comprising the following steps:

(1) using a fresh bamboo grown for 0.5-1.5 years; sawing the bamboo into bamboo segments of 0.8-3 m in length and dividing each of the bamboo segments into 4-8 parts to obtain bamboo strips of 2-4 cm in width, the bamboo strips being performed with a heat treatment and ready for use;

(2) one of the heat-treated bamboo strips being placed on the head linear rail section and secured by the clamp, the cart being installed on the head linear rail section and actuated, the cart moving along the cart guide rail and pulling the bamboo strip into the head linear rail section and continuing to pull the bamboo strip to move along the machine rail, the bamboo strip being stretched, crushed, bent and twisted while in motion to be defamed, through the cart, bamboo fiber being formed from the tail linear rail section, wherein when the cart is moved to the tail linear guide rail section, the cart is removed and the bamboo fiber is taken out, and the cart is re-installed on the head linear rail section for the next round of fiber forming so as to form bamboo fiber continuously.

Preferably, the heat treatment is performed by means of steaming: placing the bamboo strips of fixed length and width in a sealed steamer, placing the bamboo strips on a suspended a wire mesh with high-pressure steam to flow up and down for 3-5 minutes so that the bamboo strips are thoroughly heated.

Preferably, the heat treatment is performed by means of roasting placing the bamboo strips of fixed length and width in a charcoal oven and roasting for 2-3 minutes, the bamboo strips being continuously flipped during roasting so that the bamboo strips are heated evenly, the bamboo strips being taken out when green parts of the bamboo strips turn white.

Preferably, the heat treatment is performed by means of boiling: placing the bamboo strips of fixed length and width in a steam bath, heating water to a temperature of 70-95° C., keeping the bamboo strips in the water for 5-15 minutes and then taking out the bamboo strips.

Preferably, the fresh bamboo is selected from one of Omei Mountain Bamboo, Green Bamboo, Weaver's Bamboo and Moso Bamboo.

Preferably, a head end of the head linear rail section and a tail end of the tail linear rail section are enlarged.

Preferably, the continuous processing device further comprises a pick-and-place section for picking and placing the bamboo strips, and two ends of the pick-and-place section are connected to the head linear rail section and the tail linear rail section, respectively.

Preferably, the cart is famed with a groove. Two sides of the groove are symmetrically provided with at least one pair of pulleys. The cart guide rail has a T-shaped cross-section. Two ends of a transverse portion of the cart guide rail cooperate with the pulleys at the two sides of the groove.

Preferably, the conical spiral rail section has a radius of 80-800 mm and 5-15 rail loops.

The beneficial effects of the present invention are described below:

The invention provides a continuous processing device for forming bamboo fiber, which has a relatively simple structure and is easy for operation and use. The continuous processing device of the invention using the continuous processing device is simple in production process, high in efficiency, and free from pollution. The obtained bamboo fiber has good elasticity and good toughness, that is, the present invention can quickly and efficiently produce a large quantity of high-quality bamboo fiber, greatly saving the production time of bamboo fiber, improving the production efficiency, and reducing the production cost.

BRIEF DESCRIPTION OF THE DRAWINGS

Embodiments of the present invention will now be described, by way of example only, with reference to the accompanying drawings.

DETAILED DESCRIPTION OF THE PREFERRED EMBODIMENTS

Figure 1:
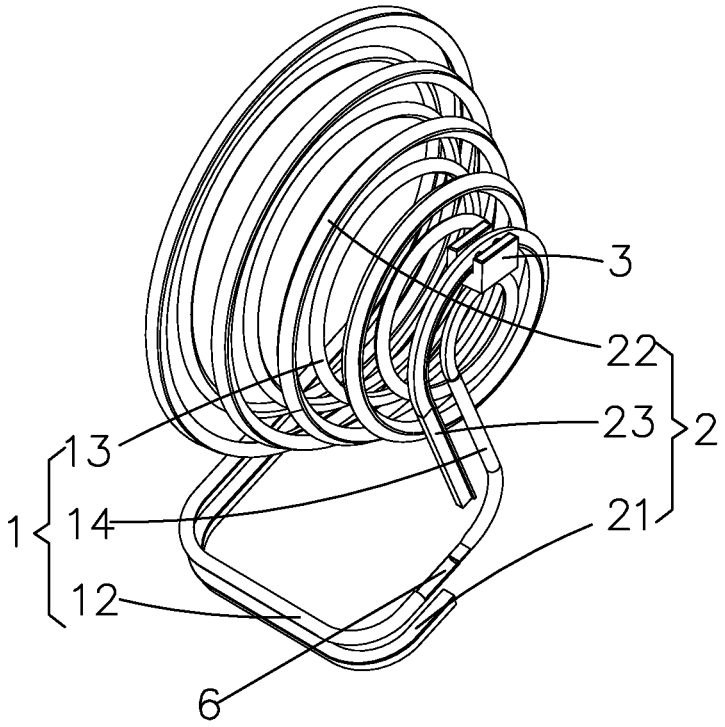
FIG. 1 is a schematic view of the continuous processing device for forming bamboo fiber according to the present invention.
Figure 2:
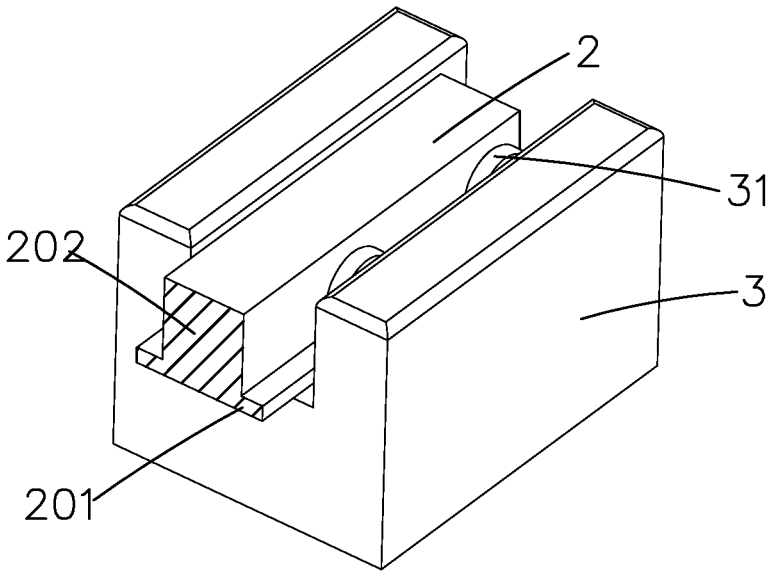
FIG. 2 is a schematic view of the assembly of the cart guide rail and the cart according to the present invention (including a partial section)
Figure 3:
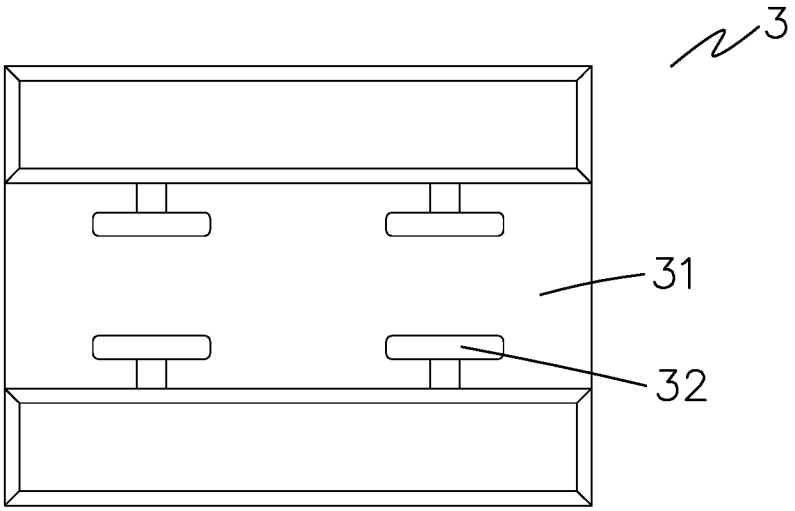
FIG. 3 is a top view of the cart according to the present invention.
Figure 4:
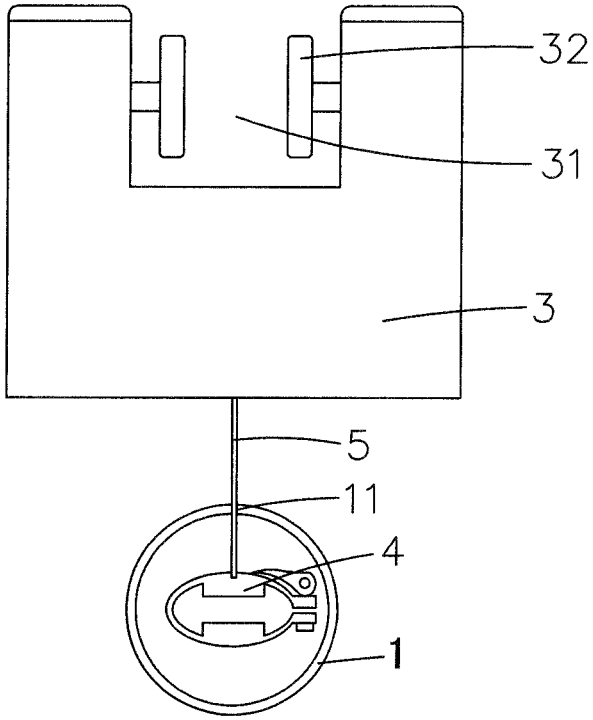
FIG. 4 is a schematic view of the cart connected with the clamp according to the present invention.

Please refer to FIG. 1 to FIG. 4, a continuous processing device for forming bamboo fiber in accordance with the present invention includes a bracket (not shown), a machine rail 1 for receiving a bamboo strip and having two ends open and hollow, a cart guide rail 2, a cart 3, and a clamp 4 for clamping the bamboo strip. The machine rail 1 and the cart guide rail 2 are mounted on the bracket, respectively. The cart 3 is slidably disposed on the cart guide rail 2. The clamp 4 is located in the machine rail 1. The cart 3 and the clamp 4 are connected through a connecting plate 5. The machine rail 1 is formed with a slot 11 along the path of the machine rail 1. The connecting plate 5 is inserted through the slot 11. When the cart 3 is running, the connecting plate 5 is driven by the cart 3 to move along the slot 11 so as to drive the clamp 4 to move along the path of the machine rail 1 within the machine rail 1, so that the bamboo strip clamped and locked on the clamp 4 can move along the path of the machine rail 1.

The machine rail 1 includes ahead linear rail section 12, a conical spiral rail section 13, and a tail linear rail section 14 arranged in sequence. The helix angle of the conical spiral rail section 13 is controlled at 10-30 degrees. The cart guide rail 2 includes ahead linear guide rail section 21, a conical spiral guide rail section 22, and a tail linear guide rail section 23 arranged in sequence. The head linear rail section 12 is arranged in parallel with the head linear guide rail section 21. The conical spiral rail section 13 and the conical spiral guide rail section 22 are arranged around the same central axis. The tail linear rail section 14 is arranged in parallel with the tail linear guide rail section 23. The cooperation of the machine rail 1 and the cart guide rail 2 can ensure that the cart 3 always drives the clamp 4 in the machine rail 1 to move when the cart 3 runs on the cart guide rail 2. It should be noted that the bamboo strip in the machine rail 1 is gradually delaminated and cracked by various forces. In order to obtain better fiber, the conical spiral rail section 13 is provided. The two ends of the machine rail 1 are open, that is, the head end of the head linear rail section 12 and the tail end of the tail linear rail section 14 are open.

In the present invention, in order to facilitate the bamboo strip to enter the machine rail 1 and to take out the bamboo fiber, the continuous processing device further comprises a pick-and-place section 6 for picking and placing the bamboo strip. Two ends of the pick-and-place section 6 are connected to the head linear rail section 12 and the tail linear rail section 14, respectively. The cart 3 is formed with a groove 31. Two sides of the groove 31 are symmetrically provided with at least one pair of pulleys 32. The cart guide rail 2 has a T-shaped cross-section, that is, the cart guide rail 2 has a transverse portion 201 and a vertical portion 202. Two ends of the transverse portion 201 of the cart guide rail 2 cooperate with the pulleys 32 at the two sides of the groove 31 so as to slide the cart 3 on the cart guide rail 2. The conical spiral rail section has a radius of 80-800mm and 5-15 rail loops.

Referring to FIG. 1, a continuous processing method for forming bamboo fiber in accordance with the present invention is implemented based on the aforesaid continuous processing device. The continuous processing method includes the following specific operations.

Fresh bamboo grown for 0.5-1.5 years is used; the bamboo is sawed into bamboo segments of 0.8-3 m in length, and each of the bamboo segments is divided into 4-8 parts to obtain bamboo strips of 2-4 cm in width. The bamboo strips are performed with a heat treatment and ready for use The heat-treated bamboo strip is placed on the head linear rail section 12 and secured by the clamp 4. The cart 3 is installed on the head linear rail section 12 and actuated. The cart 3 moves along the cart guide rail 2 and pulls the bamboo strip into the head linear rail section 12 and continues to pull the bamboo strip to move along the machine rail 1. The bamboo strip is stretched, crushed, bent and twisted while in motion, so that the bamboo strip is greatly destroyed by geometric nonlinear distortion. During this process, intricate and even cracks appear in the fiber and base structure of the bamboo. As the cracks continue to expand, the fiber and base structure are separated out into large bundles from the bamboo. By pulling the cart 3, bamboo fiber (cellulosic) is eventually produced from the tail linear rail section 14. When the cart 3 is moved to the tail linear guide rail section 23, the cart 3 is removed and the bamboo fiber is taken out. After that, the cart 3 is re-installed on the head linear rail section 12 for the next round of fiber-producing operation. This cycle is continued in order to achieve the purpose of continuous production of bamboo fiber.

Any one of the following three methods may be used for heat treatment, i.e. (a) Steaming: Place the bamboo strips of fixed length and width in a sealed steamer. The bamboo strips are placed on a suspended a wire mesh with high-pressure steam to flow up and down for 3-5 minutes, ensuring that the bamboo strips are thoroughly heated. (b) Roasting: Place the bamboo strips of fixed length and width in a charcoal oven and roast for 2-3 minutes. The bamboo strips are continuously flipped during the roasting process so that every part of the bamboo strips is heated evenly. The bamboo strips may be taken out when the green parts of the bamboo strips turn white. (c) Boiling: Place the bamboo strips of fixed length and width in a steam bath. Heat the water to a temperature of 70-95° C. and keep the bamboo strips in the water for 5-15 minutes at the constant temperature and then take out the bamboo strips.

The fresh bamboo may be selected from one of Omei Mountain Bamboo, Green Bamboo, Weaver's Bamboo or Moso Bamboo. The head end of the head linear rail section and the tail end of the tail linear rail section are enlarged to facilitate the placement of the bamboo strip on the machine rail 1 and easy removal of the processed fiber from the rail. The conical spiral rail section has a radius of 80-800 mm and 5-15 rail loops. The actual number of rail loops is mainly dependent on the objective. The more loops there are, the softer the bamboo fiber.

From the foregoing, it can be seen that the present invention provides a mechanical and physical processing method. Fully utilizing its anisotropic and non-uniform characteristics, bamboo is first heated to change its nature and compelled to move along a fixed rail. The pressure from the machine rail 1 forces the bamboo to be stretched, crushed, twisted and bent, causing it to be greatly destroyed by geometric nonlinear distortion. Cracks appear in the fiber and base structure of the bamboo during the process. As the cracks continue to expand, the fiber and base structure are separated out into large bundles from the bamboo. Furthermore, result of evaluation shows that the bamboo fiber (bundle) obtained from the processing method of the present invention is highly elastic and resilient.

Therefore, a continuous processing device for forming bamboo fiber of the present invention has a relatively simple structure and is easy to operate and use. The processing method of the present invention performed by using the continuous processing device has simple processing process, high efficiency and no pollution. The bamboo fiber (bundle) obtained from the processing method of the present invention is highly elastic and resilient. In other words, the present invention can rapidly effectively continuously prepare a large quantity of high-quality bamboo fiber, thereby greatly saving the production time of the bamboo fiber, improving the production efficiency, reducing the production cost, and increasing the application of bamboo fiber.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A continuous processing device for forming bamboo fiber, comprising a bracket, a machine rail for receiving a bamboo strip and having two ends open and hollow, a cart guide rail, a cart, and a clamp for clamping the bamboo strip, the machine rail and the cart guide rail being mounted on the bracket respectively, the cart being slidably disposed on the cart guide rail, the clamp being located in the machine rail, the cart and the clamp being connected through a connecting plate, the machine rail being formed with a slot along a path of the machine rail, the connecting plate being inserted through the slot; the machine rail including a head linear rail section, a conical spiral rail section and a tail linear rail section arranged in sequence, the conical spiral rail section having a helix angle of 10-30 degrees, the cart guide rail including a head linear guide rail section, a conical spiral guide rail section and a tail linear guide rail section arranged in sequence, the head linear rail section being arranged in parallel with the head linear guide rail section, the conical spiral rail section and the conical spiral guide rail section being arranged around a same central axis, the tail linear rail section being arranged in parallel with the tail linear guide rail section.

2. The continuous processing device as claimed in claim 1, further comprising a pick-and-place section for picking and placing the bamboo strip, two ends of the pick-and-place section being connected to the head linear rail section and the tail linear rail section, respectively.

3. The continuous processing device as claimed in claim 1, wherein the cart is formed with a groove, two sides of the groove are symmetrically provided with at least one pair of pulleys, the cart guide rail has a T-shaped cross-section, and two ends of a transverse portion of the cart guide rail cooperate with the pulleys at the two sides of the groove.

4. The continuous processing device as claimed in claim 1, wherein the conical spiral rail section has a radius of 80-800 mm and 5-15 rail loops.

* * * * *